US006863393B2

(12) United States Patent
Patterson et al.

(10) Patent No.: US 6,863,393 B2
(45) Date of Patent: Mar. 8, 2005

(54) HEAT AND AIRFLOW MANAGEMENT FOR A PRINTER DRYER

(75) Inventors: Robert S. Patterson, San Diego, CA (US); Jason S. Dewey, San Diego, CA (US); Shawn J. Mercy, San Diego, CA (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/256,038

(22) Filed: Sep. 26, 2002

(65) Prior Publication Data

US 2004/0061758 A1 Apr. 1, 2004

(51) Int. Cl.[7] ..... B41J 2/01

(52) U.S. Cl. ..... 347/102; 400/679; 400/693; 101/424.1

(58) Field of Search ..... 347/102; 101/424.1; 400/679, 693; 219/216; 34/60

(56) References Cited

U.S. PATENT DOCUMENTS

| | | | | |
|---|---|---|---|---|
| 5,296,873 | A | | 3/1994 | Russell et al. |
| 6,340,225 | B1 | | 1/2002 | Szlucha |
| 6,361,230 | B1 | | 3/2002 | Crystal et al. |
| 6,390,618 | B1 | | 5/2002 | Wotton et al. |
| 6,463,674 | B1 | * | 10/2002 | Meyers et al. ..... 34/304 |

* cited by examiner

*Primary Examiner*—Stephen D. Meier
*Assistant Examiner*—Ly T Tran
(74) *Attorney, Agent, or Firm*—Milton S. Sales; Mark G. Bocchetti

(57) ABSTRACT

An ink drying apparatus for an ink jet printer includes an internal heating apparatus. The heating apparatus comprises gas flow restrictors for air that enters the heating apparatus. The gas flow restrictors may be formed as dual horizontal slots which are sized to maintain a higher air pressure in the heating apparatus as compared to the air pressure in a region within the ink drying apparatus that is outside of the heating apparatus.

19 Claims, 6 Drawing Sheets

HEAT AND AIRFLOW MANAGEMENT FOR A PRINTER DRYER

FIELD OF THE INVENTION

The invention relates to printing. Specifically, the invention relates to drying ink during ink jet printing.

BACKGROUND OF THE INVENTION

In color ink jet printing, a relatively large quantity of ink is deposited onto the print media in a relatively short period of time. If this ink is not dried quickly, image quality can deteriorate due to ink droplet spreading, and the print media may wrinkle or cockle. In some cases, a printed image may be ruined by being rolled onto a take up reel on the printer after the image is printed but before the all of the ink is dry.

To help alleviate problems associated with variations in drying rates, methods of drying the ink during or after printing have been developed. Some of these methods involve beating various printer components with infrared radiation or by directing heated air onto the media. U.S. Pat. No. 6,361,230 for example, describes a printer with an attached dryer plenum that applies heated air to the media as it exits the printer. Dryers such as these have continued to suffer from various difficulties however. These problems include uneven temperatures across the media, a high temperature of the plenum itself, making it uncomfortable or even dangerous to touch, and inefficient operation.

SUMMARY OF THE INVENTION

In one embodiment, the invention comprises a dryer for drying a printed media. In this embodiment, the dryer comprises an outer plenum enclosure and an inner heating enclosure located substantially within the plenum enclosure. The dryer further includes a flow restriction formed between the outer plenum and the heating enclosure which is positioned and sized to limit air flow from the outer plenum enclosure into the heating enclosure, at least one heating element positioned within the inner heating enclosure, and vents for allowing air flow out of the inner heating enclosure and onto printed media external to the dryer.

In another embodiment, a printer dryer comprises a plenum enclosure forming a plenum area within, the plenum area having a higher gas pressure than outside the printer, a heating enclosure located substantially within the plenum enclosure, wherein the heating enclosure is at a lower gas pressure than in the plenum area, and vents located to provide a passageway between the heating enclosure and outside the dryer.

Methods of ink drying are also provided. In one such embodiment, a method of drying a media for use with a printer comprises pressurizing a first enclosure with a gas; routing the gas from the first enclosure and into a second enclosure such that the gas is at a lower pressure in the second enclosure than in the first enclosure, heating the gas in the second enclosure; and exhausting the heated gas from the second enclosure and onto the media.

Another embodiment of the invention is a printer comprising a media advance mechanism configured to route media through a printing mechanism in a selected direction and a dryer having a surface adjacent to the media during media travel. One or more openings in the surface of the dryer are elongated in a direction that is angled with respect to the selected direction.

DETAILED DESCRIPTION OF THE INVENTION

Embodiments of the invention will now be described with reference to the accompanying figures, wherein like numerals refer to like elements throughout. The terminology used in the description presented herein is not intended to be interpreted in any limited or restrictive manner, simply because it is being utilized in conjunction with a detailed description of certain specific embodiments of the invention. Furthermore, embodiments of the invention may include several novel features, no single one of which is solely responsible for its desirable attributes or which is essential to practicing the inventions herein described.

Figure 1:
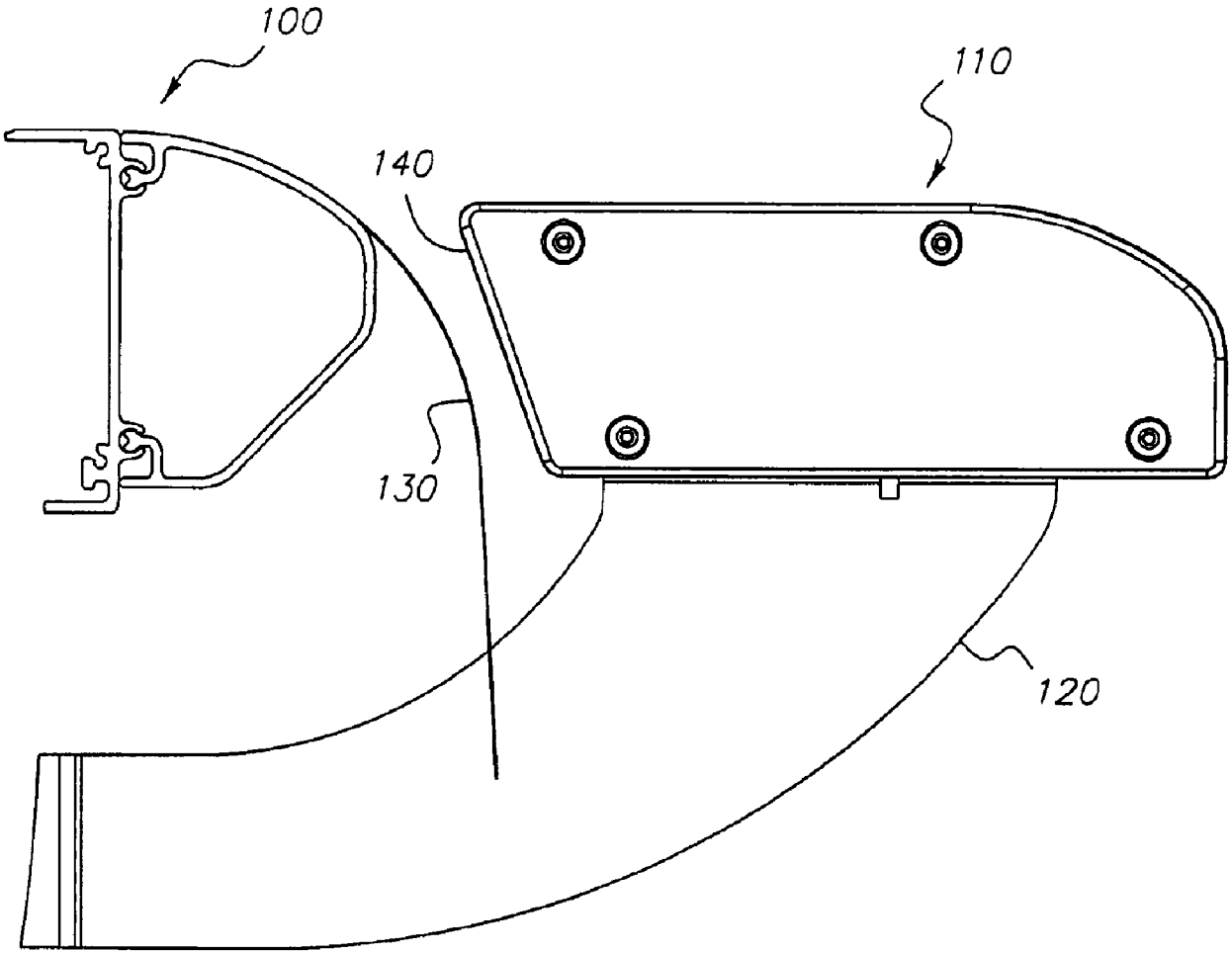
FIG. 1 is a side view of a printer and a printer dryer for an ink jet printing system with printed upon media passing therebetween.

Referring to FIG. 1, one specific embodiment of an ink jet printer 100 comprises a printer dryer 110 coupled to the printer 100 by a support bracket 120. In the embodiment of FIG. 1, the support bracket 120 attaches to a stand or other lower surface of the printer dryer 120. Typically, a roll of continuous print media 130 is mounted to a roller on the printer 100 to enable a continuous supply of paper to be provided to the printer 100 or individual sheets of paper 130 are fed into the printer 100. The media is advanced through a printing mechanism, usually by feed rollers or some other advance mechanism. The printing mechanism may, for example, include ink jet print heads. The media typically exit the printer mechanism with at least some ink that has not completely dried.

In the embodiment of the invention illustrated in FIG. 1, the media drops off the printer platen in front of the dryer 1 10 which is attached to the printer body with one or more support brackets 120. The support bracket(s) 120 are configured to support the dryer 110 a distance from the printer 100 so as to provide a small clearance between the printer dryer 110 and the media 130. While it may be preferred to minimize the distance between the media 130 and the printer dryer 110, and thus maximize heat transfer from the printer dryer and to the media, the present invention contemplates that this clearance can vary depending on the application of the printer 100. For example, the clearance can be selected based on the geometry of the platen, media exit angle from the printer 100, and the thickness and type of print media used. Moreover, when a single sheet of media 130 is used, the clearance between the media and the printer dryer 110 may vary at different locations on the sheet as the sheet passes by the printer dryer. In some cases, the support bracket 120 can position the printer dryer 110 to allow some contact between the media and the printer dryer 110. As will be explained below with reference to FIGS. 5 and 6, some embodiments of the printer dryer 110 reduce the potential for binding or snagging to occur if an edge of the media 130 contacts the printer dryer 110 during the printing process.

Embodiments of the printer 100 may use more than one support bracket 120. In one such embodiment, two support brackets extend from opposite ends of the printer 100 such that the media 130 passes therebetween.

As the media 130 passes by the printer dryer 110, the printer dryer expels heated gas through openings in the surface 140 and onto the media. The surface 140 is shown aligned approximately parallel with the media 130. However, the present invention is not so limited. As the media 130 passes through the heated exhaust, the ink droplets are dried by the heated air from the dryer 110. One advantageous configuration for vent openings in the surface 140 are described below in conjunction with FIGS. 5 and 6.

Figure 2:
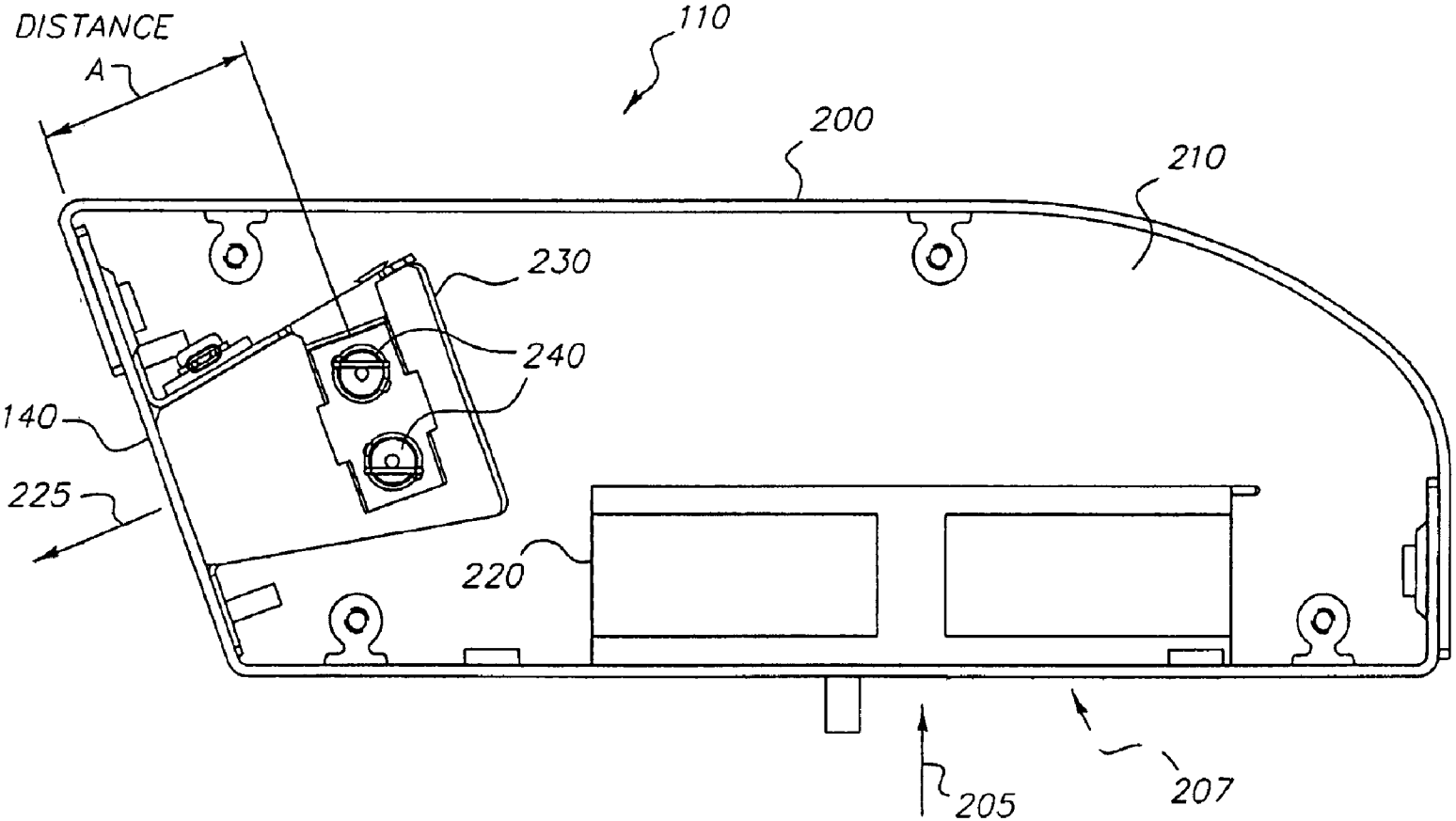
FIG. 2 is a cross-section of the printer dryer according to one embodiment of the present invention.

FIG. 2 is a cross-section of the printer dryer 110 according to one embodiment of the present invention. The printer dryer 110 comprises an outer plenum enclosure 200 which encloses a plenum volume 210. As will be explained, the plenum enclosure 200 is ventilated to allow gas to enter and exit the plenum area 210. However, as will be described, a flow path for the gas is substantially controlled as the gas passes through the plenum enclosure 200. For ease of explanation, air is used in the following description as an example of a gas that is flowed through the plenum enclosure 200, and it will be appreciated that ambient air will be the usual and most convenient source of gas for the dryer. However, the present invention is not so limited, and alternate gases can be used should this be desired in an application.

Air enters the plenum enclosure 200 in direction 205 via one or more openings 207. The openings can be a single opening or more than one adjacent opening. Examples of openings include vents, slots, and/or holes. A fan 220 is located over the opening. The fan 220 is configured to draw the air from outside of the printer dryer 110 and into the plenum volume 210. In this way, the air in the plenum volume 210 is at a higher pressure relative to the ambient air outside of the plenum enclosure 200.

Typically, although not necessarily, multiple fans 220 will be used. In embodiments with more than one fan 220, each fan will preferably be located over an opening in the plenum enclosure 200. The fans 220 can be spaced along the width of the printer dryer 110 to enhance the gas flow into the plenum enclosure 200.

The air drawn into the plenum enclosure 200 by the fan 220 flows through an internal heating enclosure 230 prior to exiting the plenum enclosure 200. The air exits the dryer 110 through surface 140 as indicated by arrow 225. The heating enclosure 230 can be in the form of a trough or channel with an open side of the channel being fixed to the inside of the surface 140 of the plenum enclosure 200. In other embodiments, the internal enclosure is four-sided, and one side of the internal heating enclosure forms the surface 140 of the dryer 110. Even though in this embodiment the heating enclosure forms a portion of the external surface of the dryer 110, it is still considered an "internal" enclosure as that term is used herein.

The heating enclosure 230 comprises heating elements 240 positioned a distance A from the surface 140 of the printer dryer 110 containing the openings for heated air to exit the enclosure. The heating elements 240 heat the air drawn in by the fan 220 which subsequently flows into the heating enclosure 230. The distance A can be selected to enhance the mixing of the heated air before the air exits the plenum enclosure 200 and contacts the media 130. In one embodiment, the heating elements are located approximately 1¼ inches behind the outlet vents in the surface 140. In the embodiment of FIG. 2, this positions the heating elements about ⅔ to ¾ of the way between the front and the rear of the internal enclosure 230. This placement helps to ensure an even exit air temperature across the entire width of the dryer to produce even drying of the media. The internal heating enclosure shown in FIG. 2 also assists in keeping the plenum volume 210 at a cooler temperature so that the exposed surface of the dryer does not become overly hot.

During operation, the air in the heating enclosure 230 is at a lower pressure relative to the air in the plenum enclosure 200 and at a higher pressure relative to the ambient air outside of the plenum enclosure 200. The higher air pressure in the plenum enclosure 200 reduces the amount of heated air leaving the internal heating enclosure 230 and returning to the plenum enclosure. The higher pressure further reduces variations in the distribution of the air entering the internal enclosure and leaving the dryer 110 along the length of the dryer 110. As will be described with reference to FIG. 3, restricting gas flow between the plenum enclosure 200 and the heating enclosure 230 enhances the pressure differential between the two enclosures.

Figure 3:
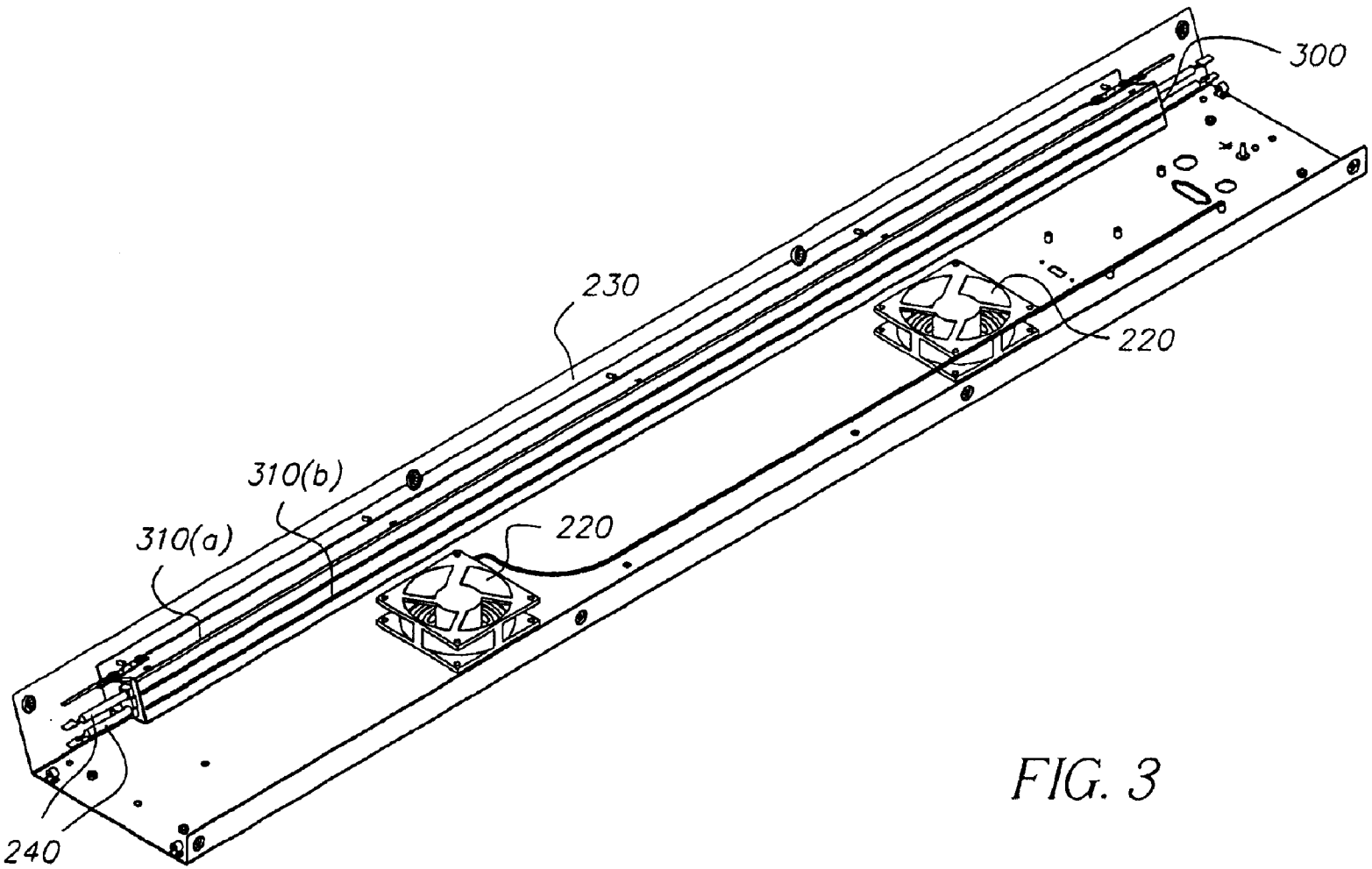
FIG. 3 is a rear perspective view of the printer dryer with a top portion of the plenum enclosure removed.

FIG. 3 is a rear perspective view of the printer dryer 110 with a portion of the plenum enclosure 200 removed. In this embodiment, the rear wall of the internal heating enclosure, delineated by the dashed line 300 of FIGS. 3 and 4, includes openings 310(*a*) and 310(*b*) of limited area. In this way, the heating enclosure 230 comprises a gas flow restriction located in a wall of the heating enclosure. The air in the plenum area 210 passes through the gas flow restriction as it enters the heating enclosure 230. The flow area of the gas flow restrictor is selected to restrict or limit the gas flow from the plenum area 210 (see FIG. 2) and into the heating enclosure 230. In this way, the heating enclosure 230 is at a lower pressure than the air pressure in the plenum area 210. The gas flow restrictor thus forms a choke point for gas entering the heating enclosure 230.

In some advantageous embodiments, the gas flow restrictor is formed by a plurality of apertures. In the embodiment of FIG. 3, the plurality of apertures 310(*a*), 310(*b*) are formed by two or more rectangular slots. In one such embodiment, the plurality of apertures 310(*a*), 310(*b*) extend along the length of the heating enclosure 230, nearly end to end in some advantageous embodiments. Alternatively, the plurality of apertures 310(*a*), 310(*b*) are in the form of a plurality of holes in the heating enclosure 230.

In the embodiment illustrated in FIG. 3, two fans 220 are positioned on a lower surface of the plenum enclosure 200 and are configured to draw the air from outside of the printer dryer 110 and into the plenum area 210. However, it will be appreciated that a single fan or three or more fans could be used.

Figure 4:
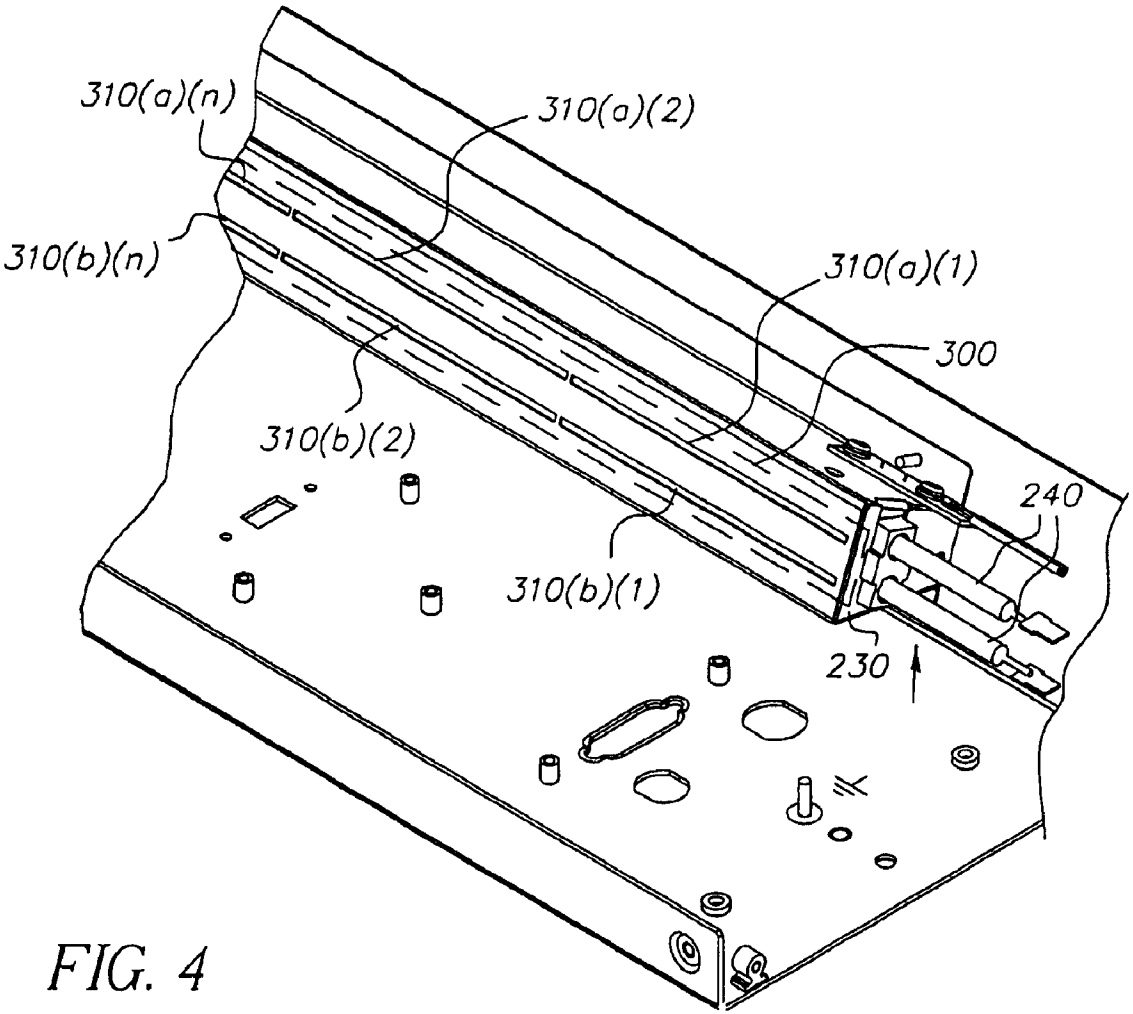
FIG. 4 is a close-up view of a gas flow restrictor located in the heating enclosure from FIG. 3.

FIG. 4 is a close-up view of the plurality of apertures 310(*a*), 310(*b*) in the heating enclosure 230 from FIG. 3. In the embodiment shown in FIG. 4, each row of apertures comprises one or more segments 310(*a*)(1)–(*a*)(*n*), 310(*b*)(1)–(*b*)(*n*). The aperture 310(*a*) comprises segments 310(*a*)(1), 310(*a*)(2), through 310(*a*)(*n*). The aperture 310(*b*) comprises segments 310(*b*)(1), 310(*b*)(2), through 310(*b*)(*n*). The segments extend along substantially the length of the heating enclosure 230 to enhance the even heating of the air that enters the heating enclosure 230. As shown in FIG. 4, the slots may be arranged in a horizontal configuration. In other embodiments, they may be angled slots, vertical slots, or appropriately sized holes.

Figure 5:
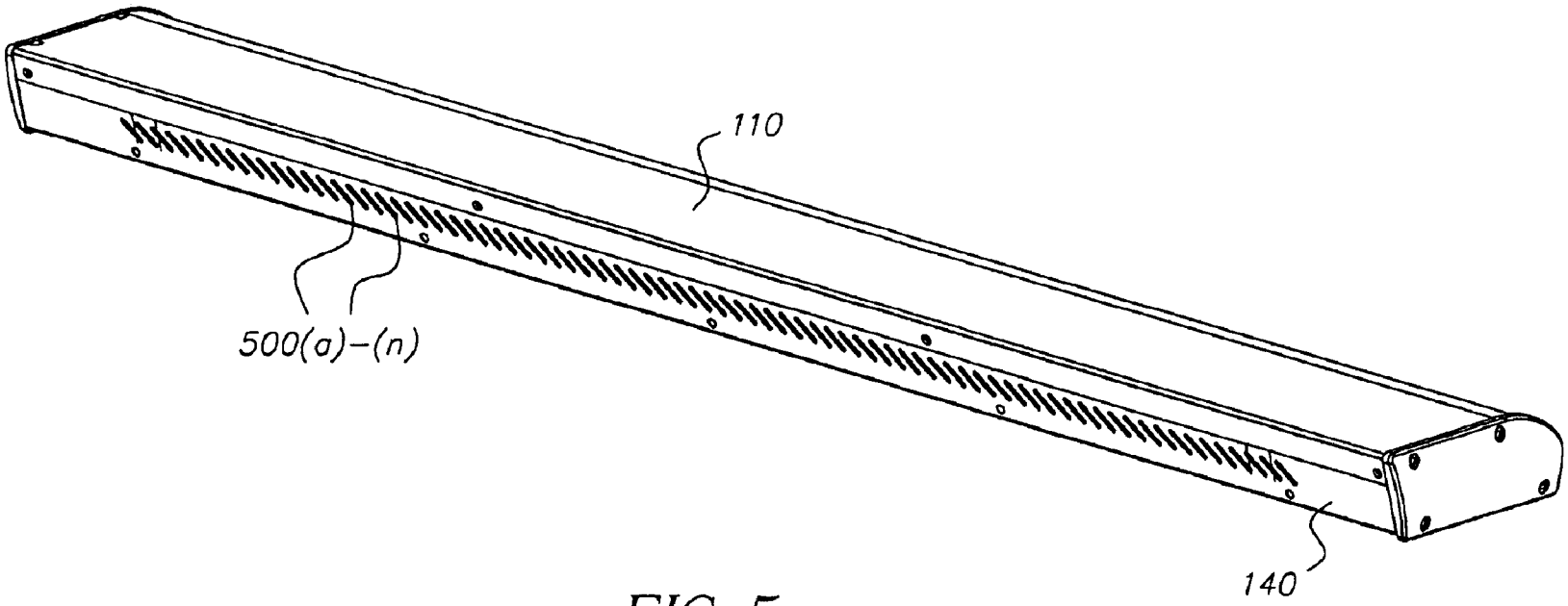
FIG. 5 is a front perspective view of the printer dryer showing angled vent holes according to one embodiment of the present invention.

FIG. 5 is a front perspective view of the printer dryer 110 showing angled vent holes 500(*a*)–(*n*) according to one embodiment of the present invention. In the embodiment shown in FIG. 5, the vent holes 500(*a*)–(*n*) are in a diagonal configuration. However, alternate arrangements of the vent holes 500(*a*)–(*n*) can be used. The angled vent holes 500(*a*)–(*n*) overlap in a direction that is parallel to the direction of the rigid or flexible media 130 as it travels by the printer dryer 110. Referring back to FIG. 2, the heated air exits the heating enclosure 230 through the vent holes 500(*a*)–(*n*) prior to contacting the media 130. Overlapping the vent holes 500(*a*)–(*n*) improves the distribution of the exiting heated air across the surface of the media 130. In this way, uneven drying of the ink that was applied to the media 130 is reduced.

Figure 6:
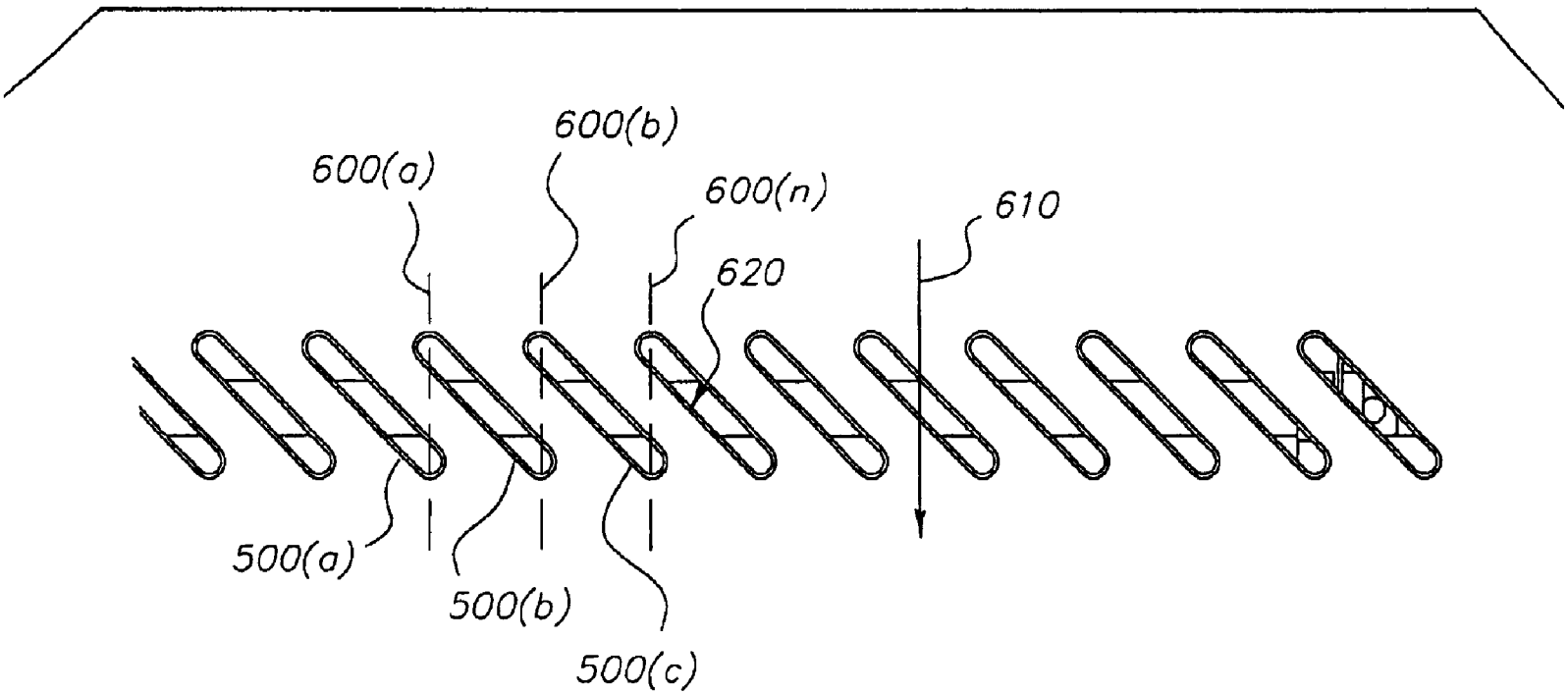
FIG. 6 is a front close-up view of the angled vent holes from FIG. 5 with the structure of the printer dryer removed.

FIG. 6 is a front close-up view of the angled vent holes 500(*a*)–(*n*) from FIG. 5. The overlapping geometry of the vent holes 500(*a*)–(*n*) is shown along dashed lines 600(*a*)–(*n*). Dashed lines 600(*a*)–(*n*) are parallel to the direction of media travel 610. Venting hole 500(*a*) and vent hole 500(*b*) overlap along dashed line 600(*a*). Venting hole 500(*b*) and vent hole 500(*n*) overlap along dashed line 600(*b*).

The angled geometry of the vent holes 500(*a*)–(*n*) further provides a means to minimize the opportunity for the vent holes to inhibit movement of the media 130 should the media 130 contact the surface of the dryer 110. Prior art heater vents have typically been configured to extend in a direction perpendicular to the direction of media travel. This enhances evenness of airflow across the entire media width. However, it has been found that when the media passes over slots having this perpendicular orientation, the leading edge can snag on the bottom edge of the vent holes. This is inconvenient during initial installation of a roll of media and can cause more serious operational problems in single sheet printing if snagging occurs during the print process.

To reduce this problem, some embodiments of the invention utilize angled slots as shown in FIGS. 5 and 6. By "angled" it is meant that the slots are oriented neither parallel nor perpendicular to media travel past the dryer. This significantly reduces the tendency of the leading edge of the media to snag on the slots as it passes the heating surface 140.

Although vertical slots which are parallel to media travel would also reduce snagging, a vertical slot orientation would tend to dry the media in stripes, rather than evenly across the entire media width. To avoid this problem, it is advantageous to provide overlapping angled slots as described above. In these embodiments, the overlapping nature of the angled slots produces even airflow across the width of the media such that drying performance remains comparable to perpendicularly oriented slots, while the incidence of snagging is significantly reduced.

In one embodiment of the printer dryer 110, the perimeter of the vent holes 600 are chamfered 620. The chamfering of the edges of the vent holes 500 lessens the opportunity for the media 130 to meet with resistance should the media 130 contact the surface of the printer dryer 110.

The invention has been described in detail with particular reference to certain preferred embodiments thereof, but it will be understood that variations and modifications can be effected within the spirit and scope of the invention.

What is claimed is:

1. A dryer for drying a printed media comprising:

an outer plenum enclosure including at least one air intake opening through an outer wall thereof;

at least one fan attached to the outer plenum adjacent to the at least one air intake opening for drawing ambient air directly through the at least one air intake vent into the outer plenum enclosure;

an inner heating enclosure located substantially within the outer plenum enclosure;

a flow restriction formed between the outer plenum and the heating enclosure which is positioned and sized to limit air flow from the outer plenum enclosure into the heating enclosure;

at least one heating element positioned within the inner heating enclosure; and at least one vent for allowing air flow out of the inner heating enclosure and onto printed media external to the dryer, the at least one air intake opening being spaced away from the at least one vent thereby reducing potential recirculation of air through the dryer.

2. The dryer of claim 1, wherein the flow restriction comprises one or more openings.

3. The dryer of claim 2, wherein the one or more openings are arranged in a horizontal configuration.

4. The dryer of claim 2, wherein at least one of the one or more openings comprise two or more segments.

5. The dryer of claim 1, additionally comprising at least one fan mounted to the plenum enclosure.

6. The dryer of claim 5, wherein the fan is located substantially within the plenum enclosure.

7. The dryer of claim 5, wherein the fan is located substantially outside the plenum enclosure.

8. The dryer of claim 1, wherein the heating enclosure is located adjacent to a surface of the plenum enclosure.

9. The dryer of claim 8, wherein the heating enclosure is formed as an open sided channel, wherein the open side of the channel is in contact with a surface of the plenum enclosure containing said vents.

10. The dryer of claim 1, wherein the at least one heating element is located at a sufficient distance from the vents to promote mixing of air within the heating enclosure.

11. The dryer of claim 1, wherein the vents comprise one or more slots.

12. The dryer of claim 11, wherein the one or more slots comprise a plurality of slots located at an oblique angle to the path of the media.

13. The dryer of claim 11, wherein a perimeter surface located around one of the one or more slots is chamfered.

14. The dryer of claim 11, wherein the vents overlap.

15. An ink jet printer comprising:

a printing device configured to controllably deposit wet ink onto a media;

a printer dryer enclosure coupled to the printer and comprising an internal heating enclosure configured to intake air from inside the printer dryer enclosure and to exhaust the air through at least one vent onto the wet media, the printer dryer enclosure including at least one air intake opening through an outer wall thereof;

at least one fan attached to the printer dryer enclosure adjacent to the at least one air intake opening for drawing ambient air directly through the at least one air intake vent into the printer dryer enclosure, the at least one air intake opening being spaced away from the at least one vent thereby reducing potential recalculation of air through the dryer; and a gas flow restrictor passage located between the internal heating enclosure and the printer dryer enclosure and configured to limit the gas flow into the internal heating enclosure, whereby the air in the internal heating enclosure is at a lower pressure than the air in the remainder of the printer dryer enclosure.

16. A dryer for drying a media that is printed upon by a printer, the dryer comprising:

a plenum enclosure forming a plenum area within, the plenum area having a higher gas pressure than outside the printer, the plenum enclosure including at least one air intake opening through an outer wall thereof;

at least one fan attached to the outer plenum enclosure adjacent to the at least one air intake opening for drawing ambient air directly through the at least one air intake vent into the outer plenum enclosure;

a heating enclosure located substantially within the plenum enclosure, wherein the heating enclosure is at a lower gas pressure than in the plenum area; and at least one vent located to provide a passageway between the heating enclosure and outside the dryer for directing heated air at the media, the at least one air intake opening being spaced away from the at least one vent thereby reducing potential recalculation of air through the dryer.

17. The dryer of claim 16, comprising a gas flow restrictor located in a surface of the heating enclosure and sized to limit gas flow from the plenum area and into the heating enclosure.

18. The dryer of claim 16, wherein the vents comprise one or more angled slots.

19. The dryer of claim 18, wherein the angled slots are overlapping.

* * * * *

UNITED STATES PATENT AND TRADEMARK OFFICE

CERTIFICATE OF CORRECTION

PATENT NO. : 6,863,393 B2
DATED : March 8, 2005
INVENTOR(S) : Robert S. Patterson et al.

It is certified that error appears in the above-identified patent and that said Letters Patent is hereby corrected as shown below:

Column 6,
Line 56, after "potential" delete "recalculation" and insert -- recirculation --.

Signed and Sealed this

Twentieth Day of September, 2005

JON W. DUDAS
*Director of the United States Patent and Trademark Office*